United States Patent [19]

Bouley

[11] 4,274,198

[45] Jun. 23, 1981

[54] SELF-STRIPPING ELECTRICAL TERMINAL

[75] Inventor: Jean-Claude A. Bouley, Dole, France

[73] Assignee: Bunker Ramo Corporation, Oak Brook, Ill.

[21] Appl. No.: 10,667

[22] Filed: Feb. 9, 1979

[30] Foreign Application Priority Data

Feb. 20, 1978 [FR] France ..... 78 04786

[51] Int. Cl.[3] ..... H01R 43/00; H01R 11/12

[52] U.S. Cl. ..... 29/866; 339/98

[58] Field of Search ..... 339/97 R, 97 P, 98; 29/863, 865, 866

[56] References Cited

U.S. PATENT DOCUMENTS

| | | | |
|---|---|---|---|
| 2,738,479 | 3/1956 | Gibson | 339/98 |
| 3,118,715 | 1/1964 | Potruch | 339/98 |
| 3,145,261 | 8/1964 | Fornay | 174/84 |
| 3,234,498 | 2/1966 | Logan | 339/97 |
| 3,258,733 | 6/1966 | Elm | 339/98 |
| 3,521,221 | 7/1970 | Lenaerts | 339/97 P |
| 3,605,071 | 9/1971 | Sedlacer | 339/97 P |
| 3,611,263 | 10/1971 | Krone | 339/97 R |
| 3,617,983 | 11/1971 | Patton | 339/98 |
| 3,718,888 | 2/1973 | Pasternak | 339/98 |
| 3,761,868 | 9/1973 | Krone | 339/98 |
| 3,772,635 | 11/1973 | Frey | 339/98 X |
| 3,793,611 | 2/1974 | Johansson | 339/98 |
| 3,793,612 | 2/1974 | Driscoll | 339/98 |
| 3,804,971 | 4/1974 | Bazille | 174/88 R |
| 3,820,055 | 6/1974 | Huffnagle | 339/97 X |
| 3,821,691 | 6/1974 | Reimer | 339/97 R X |
| 3,835,444 | 9/1974 | Plana | 339/98 |
| 3,860,318 | 1/1975 | Reavis | 339/99 |
| 3,865,460 | 2/1975 | Cherney | 339/98 |
| 3,880,489 | 4/1975 | Heneveld | 339/98 |
| 3,890,029 | 6/1975 | Izraeli | 339/98 |
| 3,892,460 | 7/1975 | Izraeli | 339/98 |
| 3,899,236 | 8/1975 | Santos | 339/98 |
| 3,910,670 | 10/1975 | Spaulding | 339/97 R |
| 3,912,356 | 10/1975 | Johansson | 339/98 |
| 3,920,305 | 11/1975 | Scott | 339/98 |
| 3,935,637 | 2/1976 | Bunnell | 339/97 P X |
| 3,937,549 | 2/1976 | Hughes | 339/97 C |
| 3,950,062 | 4/1976 | Reavis | 339/97 R |
| 3,950,065 | 4/1976 | Renn | 339/98 |
| 3,963,318 | 6/1976 | Tucker | 339/97 P |
| 3,985,416 | 10/1976 | Dola | 339/98 |
| 3,990,762 | 11/1976 | Lemesle | 339/97 R |
| 4,033,661 | 7/1977 | Moody | 339/98 |
| 4,037,905 | 7/1977 | Lucas | 339/98 |
| 4,047,784 | 9/1977 | Trank | 339/98 |
| 4,060,302 | 11/1977 | Saligny | 339/97 R |
| 4,062,614 | 12/1977 | Gressitt | 339/97 R |
| 4,068,912 | 1/1978 | Hudson | 339/99 R |
| 4,084,877 | 4/1978 | Knickerbocker | 339/97 P |
| 4,153,326 | 5/1979 | Frantz | 339/99 R |

FOREIGN PATENT DOCUMENTS

| | | | |
|---|---|---|---|
| 2102329 | 8/1972 | Fed. Rep. of Germany . | |
| 2752093 | 6/1978 | Fed. Rep. of Germany . | |
| 2247831 | 5/1975 | France . | |
| 1335708 | 10/1973 | United Kingdom | 339/98 |

*Primary Examiner*—John McQuade
*Assistant Examiner*—John S. Brown
*Attorney, Agent, or Firm*—F. M. Arbuckle; J. R. Hoffman

[57] ABSTRACT

The present invention relates to the connection of insulated electric wires, and it pertains more precisely to a terminal and a connection block for electrically connecting two insulated wires without prestripping them. Prior art connecting devices that operate without prestripping are usually in the form of a flat spring, cut in a U shape, the branches of which define a slot. In such devices, the insulated wire to be connected is introduced at the end of the slot adjacent the free ends of the branches. This type of device has a disadvantage since the perforation of the insulation is made where the deformation of the branches is the easiest. The self-stripping connecting device of the present invention is constituted by a flat spring including a portion forming a U, the branches of which are elastically biased one against the other, and an opening to allow the introduction of the insulated wire at the end of the slot adjacent the base of the U. Additionally a connecting block is disclosed which comprises an insulating box having at least one bore for receiving an insulated wire, and a movable element having a connecting device and being movable from a first position in which an inserting opening of the connecting device is in line with the bore, toward a second position in which the end of the slot remote from the opening is in line with the bore.

14 Claims, 9 Drawing Figures

SELF-STRIPPING ELECTRICAL TERMINAL

TECHNICAL FIELD

The present invention relates to the connection of insulated electric wires, and it pretains more precisely to a terminal device and a connection block for electrically connecting two insulated wires without stripping them.

BACKGROUND OF PRIOR ART

Connecting devices that operate without prestripping are known in the prior art in the form of a connecting device constituted of a flat spring, cut in a U or fork shape, the branches of which are elastically biased one against the other and provided with sharp edges and which define a slot into which is introduced the insulated wire which is to be connected, as indicated in the description of the German Utility Design No. 70 30 836.

In this device, the insulated wire to be connected is introduced at the end of the slot adjacent the free ends of the branches of the connecting device where the insulated sheath is perforated. The wire is then forced toward the other end of the slot where it is tightly held by the resilient branches.

This type of connecting device has a disadvantage inherent to its own structure, since the perforation of the insulation is made at the end of the branches, which is the portion where the deformation of the branches is the easiest, thereby requiring a strong restoring force in order that the cut in the insulating sheath can be effectively realized. Besides, the tightening of the core of the electric wire, after having been bared, is effected nearer to the common portion of the branches of the connecting organ, i.e., at a spot where the deformability of the branches is the smallest and where, consequently, these branches can damage the core of the wire if the restoring force of the branches is too strong, or can form a poor electrical, mechanical, and thermal contact in the opposite case.

In order to improve the qualities of the elasticity of the branches at the point of contact with the core of the wire to be connected, it is necessary to increase the total length of the branches and to provide at the proximity of their bases a wider recess than that of the slot for cutting the insulating material and the squeezing of the core of the conducting wire.

In order to facilitate the placement of insulated wire in this type of connecting device, the connecting blocks have been improved as described in the U.S. Pat. No. 3,936,128. In this connector, the connecting device of the above described type is mounted in the cover of a box, while the box comprises two parallel bores destined to receive the wires which are to be connected. The connection of the wires is obtained by introducing them into the respective bores of the box and placing the cover on the box.

By introducing the wires into the connecting device through the portion of the slot formed by the free end of the branches, means must be provided in the box for assuring a precise guiding of the wires and to correctly position their axes relative to the slot.

Such connector blocks present barriers to miniaturization, and the connectors require the use of different connecting devices according to the diameter of the wires to be connected, which naturally limits the flexibility of using this device and prohibits the use of a standard connecting device for two wires of a different diameter. Besides, if the wires to be connected comprise a core formed of multiple strands, a certain number of these strands cannot be correctly urged into the slot between the free ends of the branches of the connecting device, and the strands obstruct the engagement of the cover and do not make proper electrical contact.

BRIEF SUMMARY OF INVENTION

An object of the present invention is to provide a terminal device which does not require prestripping of insulated wires, and which overcomes the shortcomings of prior art devices with respect to the cutting of the insulation and the squeezing of the core of the wire.

Another object of the present invention is to provide a self-stripping connecting device for use with insulated wires of a diameter within a relatively extended range.

Another object of the present invention is to provide a self-stripping connecting block which allows progressive miniaturization and easy installation.

Another object of the present invention is to provide a standard self-stripping connecting block permitting the connection of two electric wires of greatly different diameters.

Still another object of the present invention is to provide a new process of connecting electric wires without prestripping, by means of a connector block.

These and still other objects which will be apparent from the following description are realized according to the present invention by providing a self-stripping connecting device constituted of a flat spring comprising a portion forming a U, the branches of which are elastically biased one against the other for cutting the insulating material and for assuring a reliable clamping of the core of the insulated wire introduced into the slot delimited by the branches. The device also includes a portion for connection with an element of an electric circuit and an opening to allow the introduction of the insulated wire at the end of the slot adjacent the base of the U.

According to the present invention, it is also foreseen to provide a connecting block comprising an insulating box delimiting an inner chamber and having one of its faces pierced by at least one bore for receiving an insulated wire to be connected and a mobile element forming a push button adapted for engagement with the box. The mobile element has a connecting device placed parallel with the face of the box and is movable in a direction parallel with the general direction of the branches of the connecting device from a first position in which an inserting opening of the connecting device is in line with the bore, toward a second position in which the end of the slot remote from the opening is placed in line with the bore.

The present invention also provides for a method of connecting wires without prestripping the wires, by means of a connecting block constituted by an insulating box delimiting an inner chamber and being pierced by at least one bore for receiving an insulated wire, and a mobile element forming a push-button adapted for engagement with the box and having a connecting device as described above.

The method comprises the following steps:

introducing an insulated wire into each bore of the box; and moving the pushbuttons in the box to bring the wire between the ends of the branches of the connecting device distant from their common portion.

BRIEF DESCRIPTION OF DRAWINGS

The present invention will be better understood from the following description made with reference to the attached drawings in which.

DETAILED DESCRIPTION OF INVENTION

Figure 1:
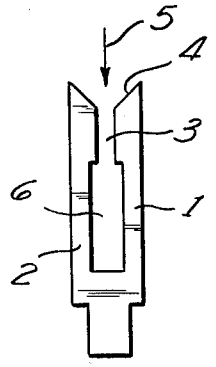
Fig. 1 (PRIOR ART)
FIG. 1 is a front view of a connecting device of the prior art.

FIG. 1 represents in elevation a connecting device of the prior art the general shape of which is that of a fork or that of a U, formed of two branches 1 and 2 extending in parallel directions and delimiting a slot 3 destined for receiving the insulated wire which has to be connected. The chamferings 4 are provided on the free end of the branches of the connecting device for enhancing the engagement of the insulated wire to be connected by movement in the direction indicated by the arrow 5. The chamferings 4 and the ends of the branches delimiting the slot 3 are generally provided with sharp edges, while a recess 6 at the base of the slot 3 has relatively thick, flat edges in view of improving the elasticity of the branches 1 and 2.

Figure 2:
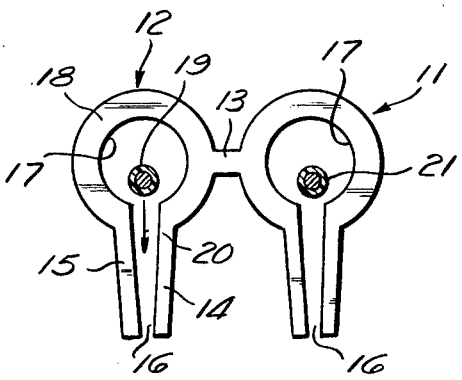
FIG. 2 is a front view of a double connecting device according to the present invention.

FIG. 2 represents in elevation a terminal device according to the present invention destined for connecting two insulated wires.

This connecting device is cut from a conductive metallic plate and comprises an elementary connecting device, generally designated by 12. The elementary connecting device 12 includes a pair of branches 14, 15 which define a slot 16 therebetween. A hole 17 of a larger width than that of the slot 16 prolongs the end of the slot 16 at the side of the portion 18 of the spring connecting each pair of branches. The hole 17 constitutes an opening to allow insertion of the insulated wire 19. This insulated wire 19 is subsequently forced into the slot 16, as indicated by the arrow 20. The width of the end of the slot 16 contiguous with the opening 17 is determined so as to cut the insulating material of the insulated wire 19 without damaging the core of this wire. The insulated wire, bared in this manner, is then brought toward the other end of the slot 16, the point at which the elasticity of the branches 14 and 15 is the best. This assures a good resistance to damage from mechanical and thermal shocks to the connection. The width of the slot 16 preferably decreases in the direction of movement of the insulated wire.

The connecting device also includes a portion generally designated 11 for connection to the element of the electric circuit to which the insulated wire 19 must be connected. In the embodiment shown in FIG. 2, this portion 11 is constituted by a second elementary connecting device according to the present invention, identical to the above-described device and attached thereto by the zone 13.

The engagement of a second insulated wire 21 by the second elementary connecting device permits the electrical connection of the wires 19 and 21 without prestripping either of the wires.

When the device is used to connect multiple strand insulated wires, it will be easily understood that the engagement of this wire by means of the insertion orifice guarantees that all of the strands will be effectively engaged in the slot 16.

Figure 3:
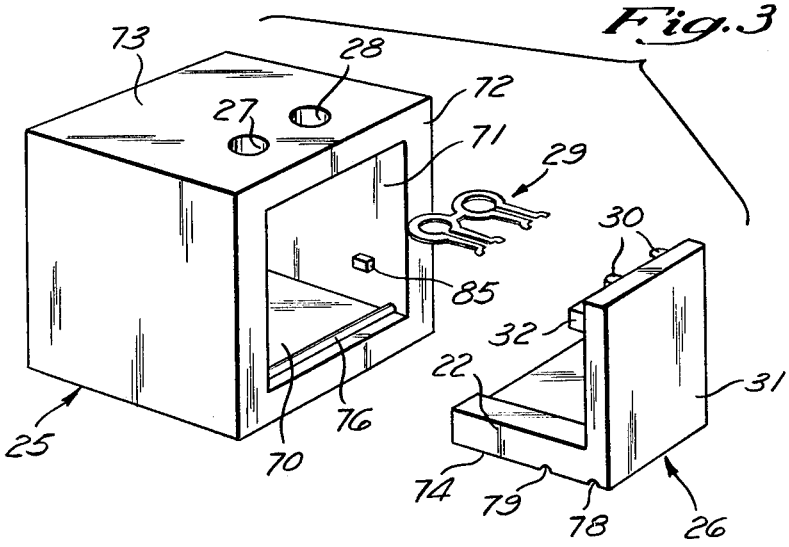
FIG. 3 is a perspective exploded view of a connecting block according to the present invention.

FIG. 3 shows an exploded perspective view of a connecting block according to the present invention, which includes a connecting device of the type represented in FIG. 2. Such a connecting block for two insulated electric wires is constituted of two portions of insulating material: a box 25; and a mobile element, generally designated by 26. Both portions may be realized, for example, by a transparent plastic material.

The box 25 of substantially parallelepiped shaped defines an inner chamber 70 for the reception of a mobile element 26 through the opening 71 in the face 72 of the box. The face 73 of the box includes two parallel bores 27 and 28, extending perpendicularly to the direction of displacement of the mobile element 26 and opening into the inner chamber 70.

Figure 6:
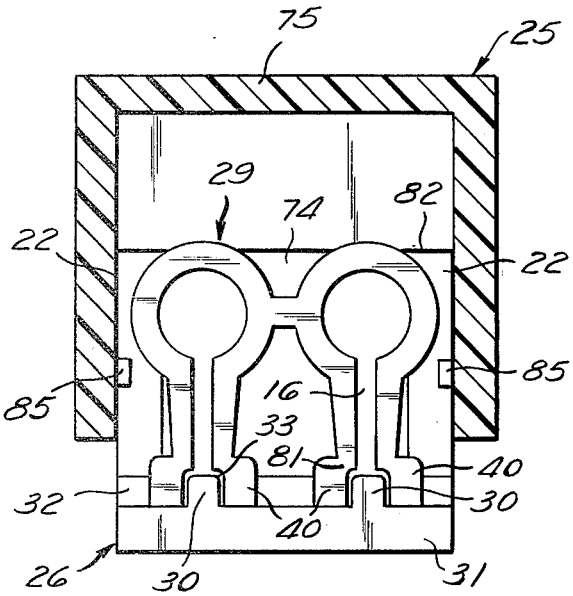
FIG. 6 represents a sectional view along the direction 6—6 of the connection block of FIG. 4.

The mobile element 26 carries the double connecting device 29, placed so that the general direction of the branches of this device are parallel with the direction of displacement of the mobile element 26 in the box 25. The connecting device 29 is held centered in the mobile element 26 by means of protrusions 30 in the cover 31, which fit between the ends of the paired branches of the connecting device, as indicated in FIG. 6. A shoulder 32 of the cover holds the connecting device perpendicular to the bores 27, 28 of the box 25, and side faces 22 and 74 of the mobile element 26 guide the element 26 in the box 25.

Parallel grooves 79 and 78 are provided in the side face 74 of the mobile element for cooperation with a rib 76 on the box 25 for assuring a correct positioning of the mobile element in the box, as will be explained in connection with FIGS. 4 and 5.

Figure 4:
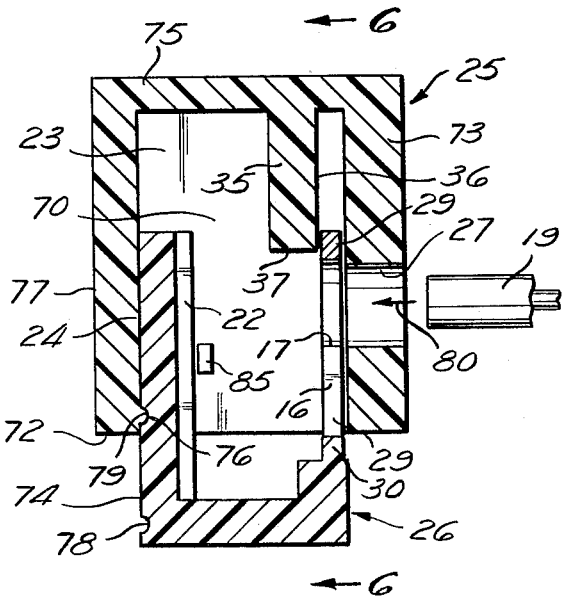
FIG. 4 is a sectional view of a connecting block according to the present invention before the introduction of the wire.

FIG. 4 shows the connecting block according to the present invention in the open position to allow introduction of the insulated wires, such as the wire 19. The box 25 includes a shoulder 35 which extends into the inner chamber 70 from the wall 75 of the box opposite the face 72 provided with the opening of the box. The surface 36 of the shoulder 35 guides the connecting device 29, and the end 37 is even with the edges of the bores 27 and 28 and serves to support the inner end of the wire.

In the open position represented in FIG. 4, the mobile element 26 is placed so that the openings 17 for connecting device 29 are in line with the corresponding bores of the box 25. This positioning is releasably maintained by the cooperation of a semicylindrical rib 76 on the inner surface of the box and a groove 79 in the face 74 of the mobile element 26.

The insulated wire 19 is inserted into the bore 27 as indicated by the arrow 80, through the opening 17 of the connecting device 29 and, preferably, its end is brought into engagement with the wall 74 of the mobile element 26.

Figure 5:
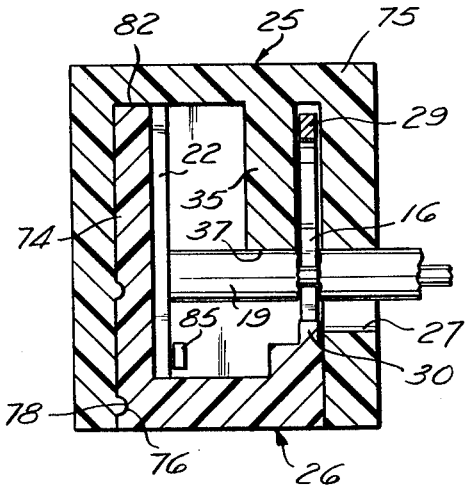
FIG. 5 is a sectional view of the connecting block of FIG. 4 after insertion of the wire which is to be connected.

Subsequently, the mobile element 26 is forced into the box 25, as indicated in FIG. 5, so as to bring the free ends of the branches of the connecting device 29 into alignment with the bores 27 and 28. The insulated wires are supported simultaneously by the walls of bores 27 and 28 and the end 37 of the shoulder 35. The movement of the mobile element causes the wires to be engaged by slot 16 of the connecting device where their insulating sheath is severed and in which they are squeezed by the free ends of the branches of the connecting organ.

It will be understood that the shape of the protrusions 30 of the cover 31 and of the spaces 33 of the supporting lugs 40 of the connecting device (FIG. 6) are determined so as not to limit the elastic restoring force of the ends of the branches of the connecting device when the wire is introduced into the device.

In the connected position, the ends 81 of the branches of the connecting organ open (separated from each other) under the action of the insulated wire engaged in the slot 16, and the connecting device is thus disengaged from cover 31.

The dimensions of the lateral faces 22 and 74 are preferably chosen so that the end 82 engages the inner surface of the wall 75 of the box in the connected position.

The maintaining of the mobile element 26 in this position is assured by the engagement of the groove 78 of the mobile element with the rib 76 of the box, and the confining action of the shoulders 85 of the box.

FIG. 6 is a sectional view along the line 6—6 of FIG. 4 which shows the protrusions 30 of the cover 31 and the lugs 40 defining the space 33 for accommodating the protrusions 30.

The connecting block of the present invention, due to the use of a connecting device of the type described in connection with FIG. 2, permits the connection of insulated wires of a relatively extended diameter range, for example between 0.4 and 0.8 mm. It is therefore possible to connect wires of different diameters within such range by means of a standard connector block.

Figure 7:
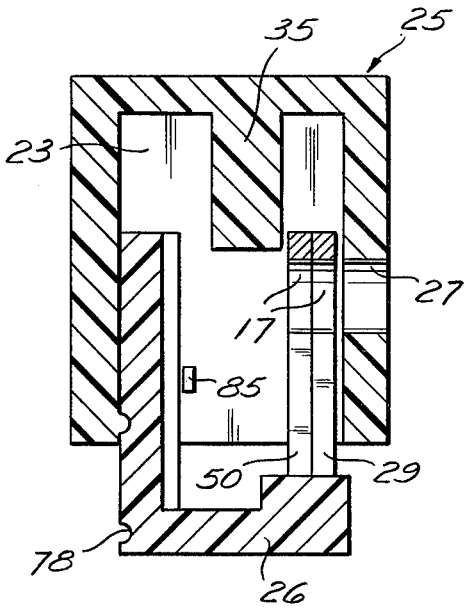
FIG. 7 is a similar view to the one in FIG. 4 and shows a connecting block provided with two connecting devices according to the present invention.

In order to further improve this flexiblity of utilization, it has been foreseen to provide in the same connector block a second connecting device shifted backward relative to the direction of wire insertion into the bores, the spacing of the branches of which, before the introduction of the insulated wires into the slots 16, is smaller than that of the first connecting organ. This second device is electrically connected to the first connecting device. Thus, a wire of a large diameter is connected by means of the first connecting organ which is placed near to the orifice of the bores. While the second connecting organ may damage or even cut the core of the cable, this does not affect the connection, since the connection is realized by the first connecting device. Similarly, an insulated wire of a small diameter is not connected by the first (larger) connecting device since the spacing of the branches is too large, but it is correctly connected by the second connecting device. FIG. 7 shows a section through a connecting block similar to that represented in FIG. 4 in which a second smaller connecting device 50 has simply been joined to the back of the first device 29.

Figure 8:
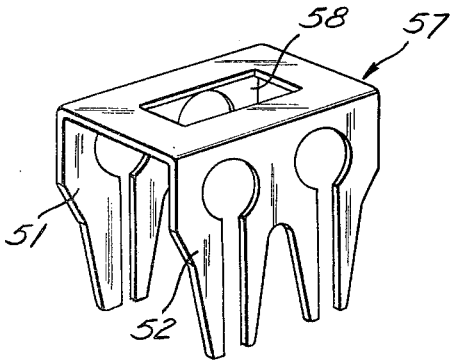
FIG. 8 is a perspective view of a connecting device according to another embodiment of the present invention.

FIG. 8 shows in perspective a connecting device 57 formed of a single sheet of metal and comprising first and second double connecting devices, 51 and 52 respectively. The spacing of the pairs of branches of the device 51 is smaller than that of the pairs of branches of device 52. The opening 58 forms a guide in the central part of the connecting device 57.

Figure 9:
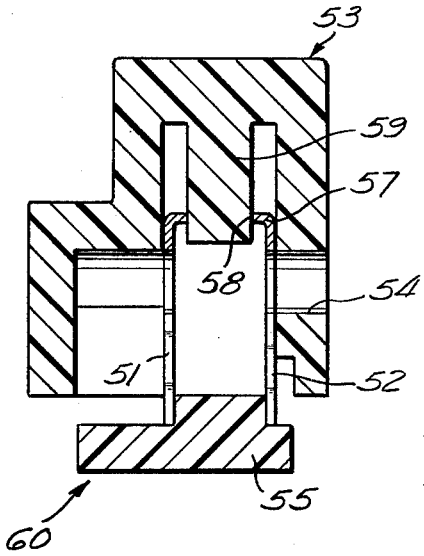
FIG. 9 is a sectional view of a connecting block comprising a connecting device of the type shown in FIG. 8.

FIG. 9 shows a connecting block similar to that shown in FIGS. 4 and 6, but incorporating the connecting device of FIG. 8. The box of insulated material 53 includes bores, such as 54, and is adapted for receiving a mobile element generally designated as 60. The mobile element 60 is formed of a cover 55 which carries the connecting device 57 and is guided by the cooperation of the guiding hole 58 of the device and the guiding finger 59 of the box.

The connecting device 57 is placed so that the larger slots of the side 52 are closer to the bores 54. The operation of this connecting block is identical with the block represented in FIG. 7.

As a further modification, the connecting devices according to the present invention can be provided with sharp edges on the sides of the branches defining the slot 16, but this arrangement is not necessary for connecting wires of small diameters.

Additionally, it will be understood that the connecting blocks according to the present invention can be easily adapted for connecting more than two wires by providing a connection device which includes sufficient coupled pairs of branches and a corresponding number of bores in the box.

Thus, the present invention is not limited to the examples described herein, but is to be limited only by the appended claims.

I claim:

1. A self-stripping electrical terminal for making electrical connection with at least one insulated electric wire, comprising a strip of resilient metal having at least one U-shaped portion formed of a base portion and two branches extending therefrom, said branches defining an open ended slot therebetween, said U-shaped portion including an opening between said branches adjacent said base portion, said opening being wider than said slot and being of a predetermined size sufficient to receive an insulated wire inserted thereinto in a direction generally transversely of the plane of said U-shaped portion, said slot being sized to resiliently engage the conductor of the insulated wire, said slot being tapered such that the width of the slot decreases with distance from said base portion.

2. The terminal as claimed in claim 1, wherein said strip includes a plurality of said U-shaped portions.

3. The terminal as claimed in claim 2, wherein the slots of said U-shaped portions are parallel to one another.

4. The terminal as claimed in claim 3, wherein each of said U-shaped portions are positioned in a single plane.

5. The terminal as claimed in claim 2, wherein said U-shaped portions are arranged in pairs, the U-shaped portions in each pair being in alignment such that a wire inserted through the opening in one said portion will extend through the opening in the associated portions, the slot of one said portion being wider than the slot of the other said portion.

6. A self-stripping electrical connector for making electrical connection with at least one insulated electric wire, comprising: an insulating box member defining an inner chamber; a movable member slidably received within said chamber; and a terminal device mounted on said movable member and movable therewith, said terminal device comprising a strip of resilient metal having at least one U-shaped portion formed of a base portion and two branches extending therefrom, said branches defining an open-ended slot therebetween, said U-shaped portion including an opening between said branches adjacent said base portion, said opening being wider than said slot and sized sufficient to receive an insulated wire inserted thereinto in a direction generally transversely of the plane of said U-shaped portion, said box member including at least one bore in communication with said chamber, said bore being positioned such that said bore is aligned with said opening when said movable member is in a first position and said opening is positioned for accepting the insulated wire, and said bore is aligned with a portion of said slot remote from said opening when said movable member is in a second position.

7. The connector as claimed in claim 6, further comprising at least one second U-shaped portion aligned with respective ones of the first-mentioned U-shaped portions and positioned remote from said bore, the slot of said second U-shaped portion being narrower than the slot of said first-mentioned U-shaped portion.

8. The connector as claimed in claim 6, wherein said terminal device includes a plurality of U-shaped portions and said box includes a corresponding plurality of bores, the slots of each of said U-shaped portions being parallel.

9. The connector as claimed in claim 6, wherein said box includes means within said chamber and aligned with said bore for supporting the inner end of a wire inserted through said bore.

10. The connector as claimed in claim 6, wherein said open-ended slot is tapered such that the width of the slot decreases with the distance from said base portion.

11. A self-stripping electrical connector for making electrical connection with at least one insulated electric wire, comprising: an insulating box member defining an inner chamber; a movable member slidably received within said chamber; and terminal means mounted on said movable member and movable therewith, said terminal means comprising a forward pair of U-shaped portions and a rearward pair of U-shaped portions, the U-shaped portions of each pair being in a common plane generally parallel to the U-shaped portions of the other pair, each U-shaped portion of each pair being formed of a base and two branches extending therefrom, said branches defining an open ended slot therebetween to resiliently engage the conductor of an insulated wire, each U-shaped portion further including an opening between said branches adjacent said base and said opening being wider than said slot to receive an insulated wire inserted thereinto in a direction generally transversely of the plane of said U-shaped portion, said box including a bore in alignment with each of said openings when said movable member is in a first position and said opening is positioned for accepting the insulated wire, and said bore is aligned with a portion of the respective slot remote from said opening when said movable member is in a second position, the slots of said forward pair of U-shaped portions being in alignment with the slots of said rearward pair of U-shaped portions, and the slots of said forward pair of U-shaped portions being wider than the slots of said rearward pair of U-shaped portions so that narrow diameter wires can be inserted through the slots of said forward U-shaped portions without interference for termination with the rearward U-shaped portions.

12. A process for establishing an electrical connection between a terminal and an insulated wire having a central conductor and an outer insulating sheath, comprising the steps of: forming the terminal in a generally U-shaped configuration with two resilient branches defining an open-ended wire receiving slot, said branches being biased together such that the slot is narrower than the conductor; forming an opening spaced from the open end of the slot and communicating with the slot and being wider than the slot for receiving the insulated wire; inserting the insulated wire into said opening; and moving said insulated wire outwardly from said opening into the open-ended slot so that the branches pierce the insulating sheath and engage the conductor of the wire.

13. The process of claim 12, wherein said slot is tapered such that the width of the slot decreases with distance from said opening, and said wire is moved outwardly along said tapered slot.

14. The process of claim 12, including the steps of providing an insulating box member defining an inner chamber; providing a movable member slidably received within said chamber; mounting one of said U-shaped terminal on said movable member for movement therewith; providing a bore in said insulating box member in alignment with said opening when said movable member is in a first position and said opening is positioned for accepting the insulated wire; and moving said movable member to a second position wherein said bore is aligned with a portion of said slot remote from said opening to thereby move said wire outwardly from said opening into said slot.

* * * * *